US007415829B2

(12) United States Patent
Rolff

(10) Patent No.: US 7,415,829 B2
(45) Date of Patent: Aug. 26, 2008

(54) PISTON COMPRESSOR

(75) Inventor: Norbert Rolff, Horrem (DE)

(73) Assignee: Oerlikon Leybold Vacuum GmbH, Cologne (DE)

( * ) Notice: Subject to any disclaimer, the term of this patent is extended or adjusted under 35 U.S.C. 154(b) by 424 days.

(21) Appl. No.: 10/537,639

(22) PCT Filed: Dec. 9, 2003

(86) PCT No.: PCT/EP03/13916

§ 371 (c)(1),
(2), (4) Date: Jun. 6, 2005

(87) PCT Pub. No.: WO2004/053331

PCT Pub. Date: Jun. 24, 2004

(65) Prior Publication Data

US 2006/0090477 A1 May 4, 2006

(30) Foreign Application Priority Data

Dec. 12, 2002 (DE) ..... 102 57 951

(51) Int. Cl.
*F25D 25/00* (2006.01)
*F01B 31/00* (2006.01)
*F04B 43/12* (2006.01)

(52) U.S. Cl. ..... 62/6; 92/127; 417/53

(58) Field of Classification Search ..... 62/6; 92/127; 417/53
See application file for complete search history.

(56) References Cited

U.S. PATENT DOCUMENTS 4,387,568 A * 6/1983 Dineen ..... 60/520
4,543,793 A 10/1985 Chellis et al. ..... 62/6
4,545,738 A * 10/1985 Young ..... 417/53
4,553,398 A * 11/1985 Young ..... 62/6
4,574,591 A 3/1986 Bertsch ..... 62/6
4,644,851 A 2/1987 Young ..... 92/127
4,735,862 A * 4/1988 Heinzl et al. ..... 428/550
4,840,032 A * 6/1989 Claudet et al. ..... 62/6
5,775,273 A 7/1998 Beale ..... 123/46
5,901,737 A * 5/1999 Yaron ..... 137/246.12

(Continued)

FOREIGN PATENT DOCUMENTS

DE 34 31 586 C2 4/1985

(Continued)

*Primary Examiner*—William C Doerrler
(74) *Attorney, Agent, or Firm*—Fay Sharpe LLP

(57) ABSTRACT

A piston compressor comprises a piston (12) which oscillates in a cylinder (14). A compressed-gas supply arrangement is provided which comprises a compressed-gas accumulator (34), a compressed-gas supply line (18) between a compressed-gas source (20) and the compressed-gas accumulator (34). Further, the compressed-gas supply line (18) comprises an inlet valve (42) which is open when the piston (12) is in a filling position. The inlet valve (42) is defined by a cylinder wall opening (22) and a piston wall opening (38) which are located opposite each other when the piston (12) is in the filling position, thus defining an open valve, and which are closed by the piston wall (40) and the cylinder wall (24), respectively, when the piston (12) is in the non-filling position, thus defining a closed valve. Thereby, a valve is provided which does not comprise any moving parts and is thus easy to manufacture, is highly reliable and has a long service life.

18 Claims, 5 Drawing Sheets

U.S. PATENT DOCUMENTS

| | | | | |
|---|---|---|---|---|
| 5,987,886 | A | 11/1999 | Sekiya et al. | 60/523 |
| 6,016,738 | A | 1/2000 | Elferink | 92/127 |
| 6,035,637 | A * | 3/2000 | Beale et al. | 60/595 |
| 6,170,442 | B1 | 1/2001 | Beale | 123/46 B |
| 6,231,310 | B1 | 5/2001 | Tojo et al. | 417/44.1 |
| 6,379,125 | B1 | 4/2002 | Tojo et al. | 417/417 |

FOREIGN PATENT DOCUMENTS

| | | |
|---|---|---|
| DE | 695 11 438 T2 | 2/2000 |
| DE | 697 06 629 T2 | 7/2002 |
| EP | 0 279 739 | 8/1988 |
| EP | 0 864 750 | 9/1998 |
| WO | WO 96/15369 | 5/1996 |

* cited by examiner

PISTON COMPRESSOR

The invention relates to a piston compressor comprising a piston on gas bearing.

Piston compressors on gas hearing are used, inter alia, in Stirling coolers, piston vacuum pumps, and other gas compressors. Supporting a piston on a gas bearing in a cylinder allows for a lubricant-free and low-resistance support of the piston in the cylinder. Such a piston compressor is shown in U.S. Pat. No. 6,016,738. For the support on a gas bearing, the piston compressor comprises a gas bearing arrangement having a compressed-gas accumulator which is connected with gas bearing nozzles and supplies the latter with compressed gas at overpressure. The compressed-gas accumulator is supplied with gas which is compressed by the piston in a cylinder pressure space when the piston is in a filling position, and which has a high gas pressure. To prevent the highly pressurized gas from flowing out of the compressed-gas accumulator back into the cylinder space when the piston is not in its filling position and there is a low pressure in the cylinder space, a mechanical check valve, e. g. a flatter valve, is provided in the compressed-gas supply line between the cylinder pressure space and the compressed-gas accumulator. Mechanical check valves display mechanical inertia, may get stuck or display leaks and are subject to wear.

It is thus an object of the invention to provide a piston compressor with gas bearing comprising an improved inlet valve.

SUMMARY OF THE INVENTION

This object is achieved by a device with the features of claim 1.

The piston compressor according to the invention comprises an inlet valve in the compressed-gas supply line, the valve being defined by a cylinder wall opening and a piston wall opening. In the filling position of the piston, the cylinder wall opening and the piston wall opening are located opposite each other and define an open valve. In a non-filling position of the piston, the cylinder wall opening and the piston wall opening are closed by the respective opposite piston wall and cylinder wall, respectively, and define a closed valve. The cylinder wall opening and the piston wall opening are arranged relative to each other in such a way that the valve is opened at a high gas pressure and closed at a low gas pressure in the compressed-gas supply line. The opening and closing processes are not directly dependent on the gas pressure in the compressed-gas supply line but on the position of the piston. A check valve is not absolutely necessary so that no moving mechanical parts are required for the inlet valve. The inlet valve defined by the cylinder wall opening and the piston wall opening operates without time lag, is highly reliable and can be manufactured at a relatively low expenditure.

Preferably, the cylinder wall opening and/or the piston wall opening are con-figured as circular grooves. Thus, in the filling position of the piston, the cylinder wall opening and the piston wall opening are located opposite each other at each angle of rotation of the piston such that the piston need not be guided in the cylinder with regard to its rotational position.

According to a preferred embodiment, the compressed-gas supply line is arranged in the cylinder housing between the cylinder pressure space and the inlet valve. This arrangement is particularly appropriate when the compressed-gas accumulator is located in the piston, and a single inlet valve is provided. The compressed gas is fed from the cylinder pressure space via the compressed-gas supply line in the cylinder housing to the inlet valve. When the piston wall opening is located opposite the cylinder wall opening, the compressed gas flows into the compressed-gas accumulator in the piston. When the piston has moved out of its filling position, the inlet valve defined by the cylinder wall opening and the piston wall opening is closed again, and the compressed gas in the compressed-gas accumulator can no longer escape through the inlet valve. In this manner, a simple compressed-gas supply of a piston arranged in a cylinder is realized.

According to a preferred embodiment, the compressed-gas accumulator and the gas bearing nozzles are arranged in the piston. The gas bearing nozzles are directly connected via the connecting lines in the piston with the compressed-gas accumulator. Generally, the compressed-gas accumulator can also be arranged in the housing.

Preferably, the compressed-gas supply line is arranged in the piston between the piston bottom facing the cylinder pressure space and the piston side wall. This arrangement is appropriate when a compressed-gas accumulator is provided at the housing, or when a plurality of inlet valves arranged in series one behind the other are provided.

According to a preferred embodiment, a second inlet valve is provided in the compressed-gas supply line, which is defined by a second cylinder wall opening and a second piston wall opening, and which is opened when the piston is in its filling position. In the filling position of the piston, the compressed gas flows through the two open inlet valves into the compressed-gas accumulator.

The sealing length existing in the gap between the piston and the cylinder, when the piston is in its non-filling position, is approximately as large as the piston stroke minus an opening diameter. By providing a plurality of inlet valves, the effective sealing length can be increased accordingly. This is required in particular in the case of a short piston stroke where, in the non-filling position of the piston, the piston wall opening does not move far away from the cylinder wall opening. By providing the second inlet valve, the sealing effect is considerably improved in the non-filling position of the piston, i. e. the so-called gas leakage is reduced. The inlet valves are preferably located at different angular and longitudinal positions of the cylinder. It is also possible to arrange three, four or more inlet valves in series one behind the other in the gas supply line.

According to a preferred embodiment, an anti-twist device is provided which prevents the piston from twisting in the cylinder. This is provided in particular when a plurality of inlet valves are provided which are arranged relative to each other at certain fixed angles of rotation.

Preferably, each gas bearing nozzle is formed by a wire inserted in a nozzle bore. Between the wire and the cylindrical bore wall an annular gap is formed through which the gas from the gas bearing nozzles, which has been throttled accordingly, flows out. Alternatively, each gas bearing nozzle can be formed by a gas-permeable plug made from sintered material, e. g. high-grade steel.

The gas bearing nozzles are arranged in a transversal plane of the piston at the level of the two piston end portions. Thus, a stable gas bearing for the piston in the cylinder is realized. The gas bearing nozzles may be provided in the piston, but may also be provided in the cylinder housing. The gas bearing nozzles may further be partly arranged in the piston and partly in the cylinder housing. Arrangement of the gas bearing nozzles in the piston offers the advantage that the nozzles follow the movement of the piston such that the radial stabilization forces uniformly act upon the piston. Arrangement of the gas bearing nozzles in the cylinder housing offers the advantage that the compressed-gas supply may to a large extent be arranged in the stationary cylinder housing.

According to a preferred embodiment, the piston compressor comprises a pneumatic piston end-position control device, wherein a constant-pressure source can produce a gas pressure, which is constant as compared with the piston pressure stroke, and is directly connected with a cylinder wall opening. Further, a control pressure accumulator is arranged in the piston and is directly connected with a control pressure accumulator piston wall opening. When the piston is in its filling position, a constant gas pressure from the constant-pressure gas source is applied to the control pressure accumulator. A line is provided between the constant-pressure gas source and a second cylinder wall opening which defines together with the control pressure accumulator piston wall opening a charge valve and is located opposite the control pressure accumulator piston wall opening when the piston is in its end position such that the gas pressure of the control pressure accumulator adjusts itself to the gas pressure of the constant-pressure gas source. The piston end-position control device is provided in addition to the piston gas bearing, wherein one compressed-gas accumulator each is provided for the piston bearing and for the piston end-position control device, and the two devices operate separately and independently of each other.

By means of the piston end-position control device a gas amount is fed from the control pressure accumulator into the cylinder pressure space when the piston is in a certain position other than the filling position or the end position. In this manner, the gas amount in the cylinder pressure space concerned is kept relatively constant. During the following compression of the gas in the cylinder pressure space, the piston end-position, which is determined by the gas pressure in the cylinder pressure space, is always at the same location. In this manner, control of the piston end-position of a free-swinging piston is realized, i.e. of a piston which is not mechanically coupled with a crankshaft or the like. The pneumatic piston end-position control device need not necessarily be part of the piston compressor but may serve as an independent end-position control device for any type of piston-cylinder arrangement.

According to a preferred embodiment, the piston compressor forms part of a Stirling cooler comprising a cold finger. The cold finger is formed by a displacer piston in a cold finger cylinder housing. The cold finger comprises its own compressed-gas accumulator and gas bearing nozzles connected with the latter for supporting the displacer piston, or, alternatively, a common compressed-gas accumulator is provided outside the piston. The cold finger compressed-gas accumulator is connected via a cold finger gas supply line with the piston compressor compressed-gas accumulator. In the cold finger gas supply line a cold finger valve is arranged which is defined by a piston wall opening and a cylinder wall opening of the piston compressor and which is open when the piston compressor piston is in its filling position. For supplying the cold finger gas bearing, compressed gas from the piston compressor compressed-gas accumulator is fed to the cold finger compressed-gas accumulator provided for this purpose. The feeding is appropriately effected at that moment when the piston of the piston compressor is in its filling position since at this moment the maximum gas pressure for supplying the compressed-gas accumulator is available. In the filling position of the piston compressor piston the cold finger valve between the two compressed-gas accumulators is thus open such that compressed gas from the cylinder pressure space of the piston compressor flows both into the piston compressor compressed-gas accumulator and the cold finger compressed-gas accumulator. In this manner, use of flatter valves or other mechanical valves for isolating the compressed gas in the cold finger compressed-gas accumulator is made unnecessary.

One advantage is high reliability.

Another advantage resides in a relatively low manufacturing cost.

Still further advantages of the present invention will be appreciated to those of ordinary skill in the art upon reading and understanding the following detailed description.

BRIEF DESCRIPTION OF THE DRAWING

The invention may take form in various components and arrangements of components, and in various steps and arrangements of steps. The drawings are only for purposes of illustrating the preferred embodiments and are not to be construed as limiting the invention.

DETAILED DESCRIPTION OF THE PREFERRED EMBODIMENTS

FIGS. 1-8 show several embodiments of a piston compressor which is e. g. used as a component part of a Stirling cryocooler. A Stirling cryocooler comprising a piston compressor is shown in FIG. 9.

Figure 1:
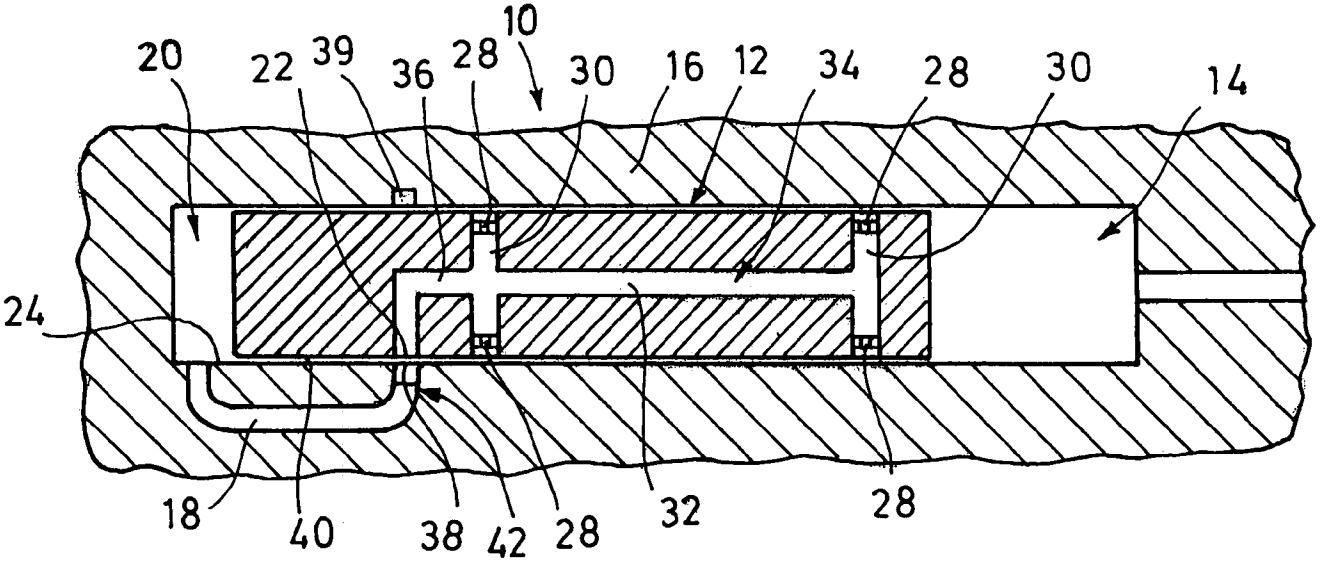
FIG. 1 shows a first embodiment of a piston compressor, with the piston in its filling position.
Figure 2:
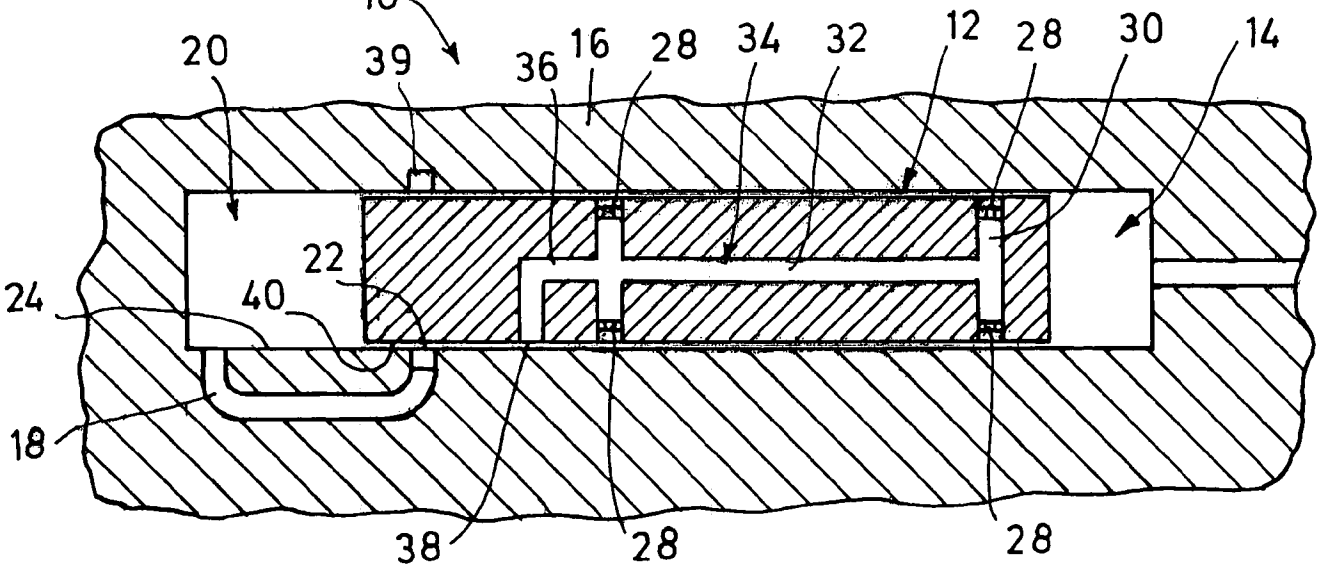
FIG. 2 shows the piston compressor of FIG. 1, with the piston in a non-filling position.

A first embodiment of a piston compressor 10 is shown in FIGS. 1 and 2. The piston compressor 10 essentially includes a piston 12 oscillating in a cylinder 14 between two end positions shown in FIGS. 1 and 2, respectively.

In the housing 16 of the cylinder 14 a compressed-gas supply line 18 is provided which connects a cylinder pressure space 20 at one cylinder end with a cylinder wall opening 22 in the cylinder side wall 24.

The piston 12 comprises four gas bearing nozzles 28 arranged in two planes, the nozzles being connected with each other by transverse ducts 30 and a longitudinal duct 32. At least three gas bearing nozzles are to be provided in each plane. The transverse and longitudinal ducts 30,32 jointly form a compressed-gas accumulator 34 which contains a sufficient volume of compressed gas for supplying the gas bearing nozzles 28 with compressed gas during a cycle. The compressed-gas accumulator 34 formed by the ducts 30,32 further comprises a connecting duct 36 which enters a piston wall opening 38 in the piston side wall 40. To the piston wall opening 38 a circular groove 39 extending in circumferential direction is associated, the groove extending over the overall circumference of the cylinder side wall 24.

The cylinder wall opening 22 and the piston wall opening 38 jointly define an inlet valve 42 through which compressed gas flows out of the cylinder pressure space 20 into the compressed-gas accumulator 34 when the piston 12 is in the filling or end position shown in FIG. 1. In the non-filling position shown in FIG. 2, the inlet valve 42 is closed. In the non-filling position of the piston 12, as in the filling position, the compressed gas from the compressed-gas accumulator 34 is slowly discharged via the gas bearing nozzles 28.

Each gas bearing nozzle 28 comprises a wire inserted in an axial bore, the wire defining an annular gap in the axial bore. In this manner, a pressure drop is realized in the gas bearing nozzle, which prevents the gas retained under pressure in the compressed-gas accumulator 34 from escaping too quickly. Alternatively, a plug of sintered material, e. g. high-grade steel, can be inserted in the bore.

During the entire cycle, the gas escapes slowly. The gas pressure in the compressed-gas accumulator 34 decreases so slowly that practically during the entire moving cycle of the piston 12 a gas pressure prevails which is sufficient to retain the piston 12 in the center of the cylinder.

The gas bearing nozzles 28 are distributed over the piston length and the piston circumference and act as throttles. The gas bearing nozzles 28 are continuously supplied with compressed gas from the compressed-gas accumulator 34. The compressed gas flowing out through the gas bearing nozzles 28 forms a gap between the piston 12 and the cylinder housing 16, via which the piston 12 is retained in the center of the cylinder and contactlessly reciprocates in the cylinder housing 16.

The throttling resistance of the gas bearing nozzles 28 lies approximately in the same order of magnitude as the throttling resistance of the gas flow between the piston 12 and the cylinder 14 when the piston 12 is approximately in the radial center of the cylinder 14. Thus, the pressure in the gap between the piston 12 and the cylinder 14 near the gas bearing nozzles 28 amounts to approximately half the pressure prevailing upstream of the gas bearing nozzles, i. e. the pressure inside the compressed-gas accumulator 34. Approximately the same pressure prevails at all sides of the piston 12. When a force acts upon the piston 12, the piston 12 yields to the force and moves in radial direction towards the cylinder wall 24. Thus, the gap between the piston wall 40 and the cylinder wall 24 becomes smaller in this area. Thereby, the throttling effect of the gap between the piston wall 40 and the cylinder wall 24 is increased in this area, whereby the piston 12 is pressed, against the disturbance force acting in radially outward direction, in radially inward direction towards the center of the cylinder.

For operating the gas bearing, a gas pressure exceeding the ambient pressure is required in the compressed-gas accumulator 34. During a cycle, the gas pressure is tapped from the cylinder pressure space 20 when the piston 12 is in its filling position shown in FIG. 1, the cylinder pressure space having, at this moment, a high gas pressure. In this position, the inlet valve 42 defined by the cylinder wall opening 22 and the piston wall opening 38 is open such that the highly pressurized gas can flow out of the cylinder pressure space 20 into the compressed-gas accumulator 34. When the piston 12 has left its filling position, the piston wall 40 is located opposite the cylinder wall opening 22, and the cylinder wall 24 is located opposite the piston wall opening 38 such that the inlet valve 42 is closed.

When the piston 12 has a circular cross-section and the cylinder 14 is of circular configuration, associating the circular groove 39 to the piston wall opening 38 ensures that in the filling position of the piston 12 the inlet valve 42 actually opens at each rotational position of the piston 12.

A constant gas pressure, e. g. atmospheric pressure, is applied to the cylinder 14 at the end opposite the cylinder pressure space 20. The piston is actuated by an actuator which is not shown, e. g. a stationary electromagnet in conjunction with a piston spring, or a magnet carrying along the piston and moving in axial direction.

Figure 5:
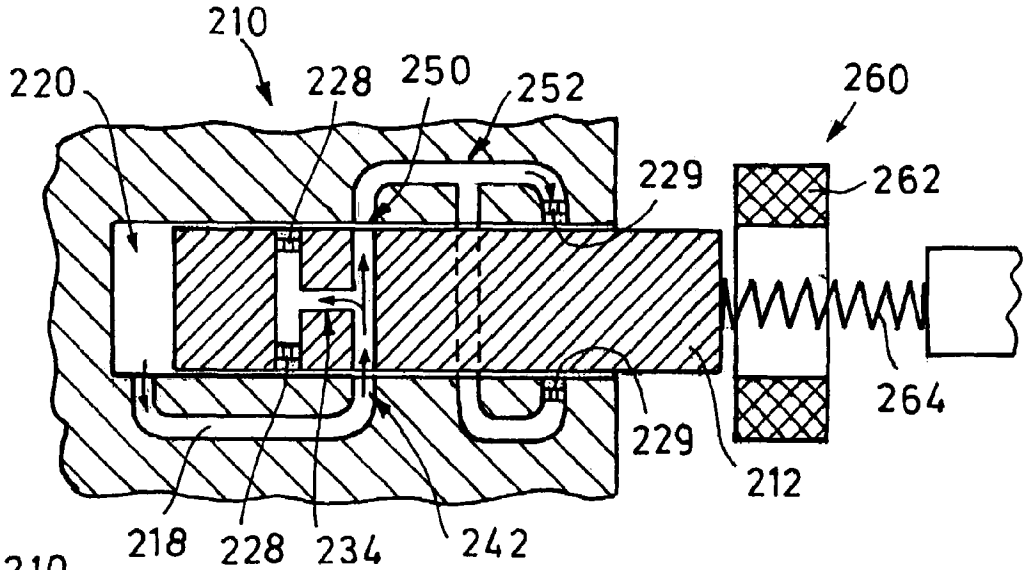
FIG. 5 shows a third embodiment of a piston compressor, with the piston in its filling position.
Figure 6:
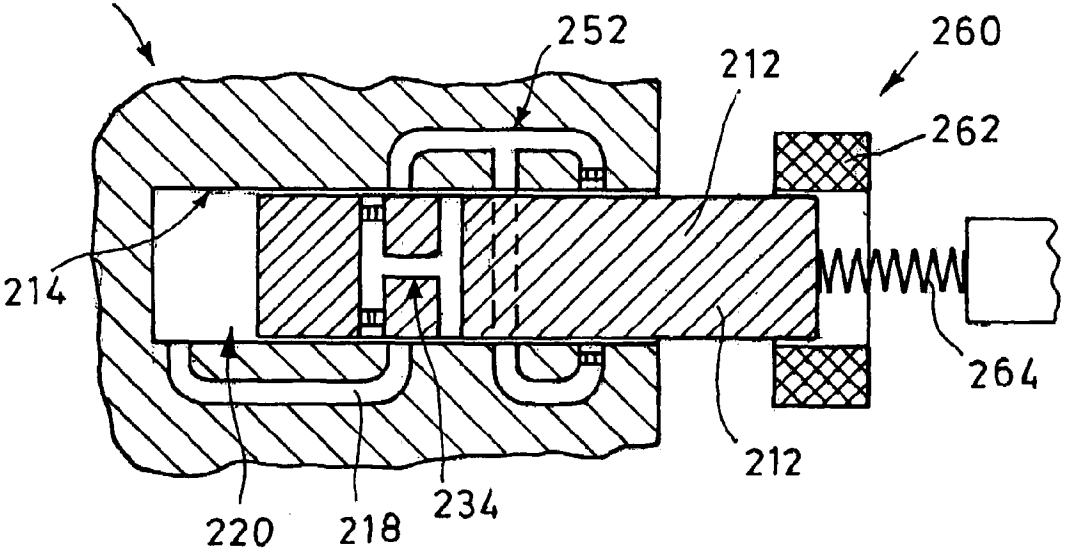
FIG. 6 shows the piston compressor of FIG. 5, with the piston in a non-filling position.

An example of an actuator is explained in detail in the embodiment illustrated in FIGS. 5 and 6.

Figure 3:
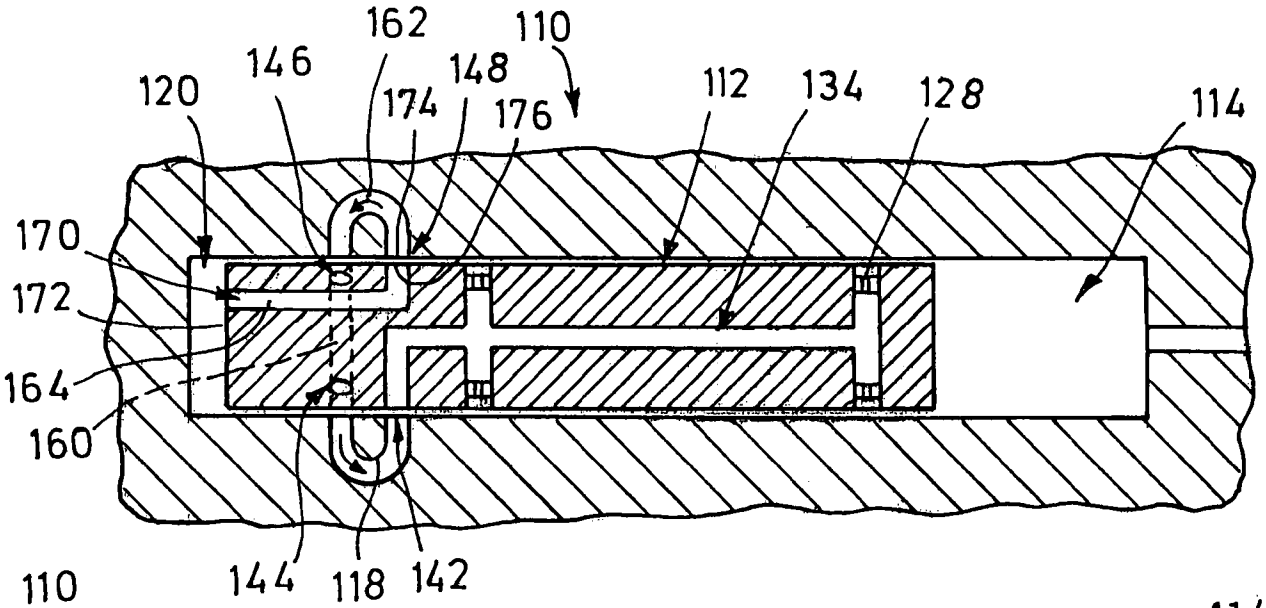
FIG. 3 shows a second embodiment of a piston compressor, with the piston in its filling position.
Figure 4:
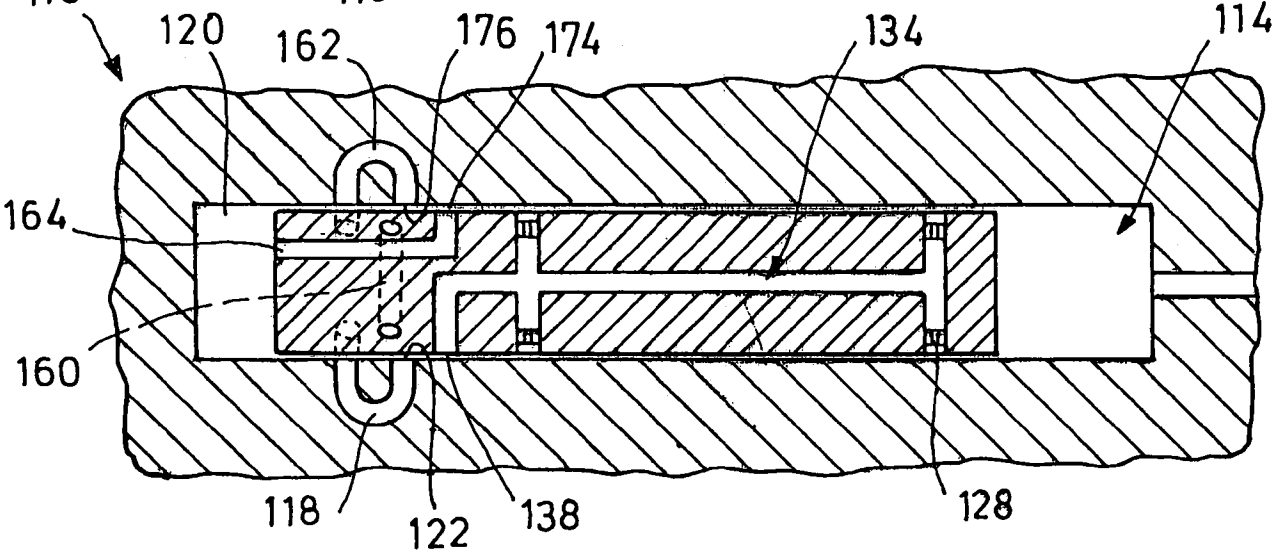
FIG. 4 shows the piston compressor of FIG. 3, with the piston in a non-filling position.

In the second embodiment shown in FIGS. 3 and 4 the reference numerals of the embodiments shown in FIGS. 1 and 2 incremented by 100 are used as far as they relate to the same parts. The same applies mutatis mutandis to all other embodiments with the reference numerals being incremented by 200, 300 and 400, respectively.

In the second embodiment of a piston compressor 110 shown in FIGS. 3 and 4, as compared to the first embodiment, a plurality of inlet valves 142,144, 146,148 are arranged in series one behind the other in the compressed-gas line 118, 160,162,164.

In this piston compressor 110 a section of the compressed-gas line 164 is arranged in the piston 112 between an opening 170 in the piston bottom 172 and a second piston wall opening 174 which defines together with a second cylinder wall opening 176 the inlet valve 148. The remaining inlet valves 142, 144,146, too, are defined by a piston wall opening and a cylinder wall opening located opposite the piston wall opening when the piston is in its filling position.

All four inlet valves 142-148 are opened when the piston 112 is in its filling position shown in FIG. 3 and are closed when the piston 112 is in its non-filling position shown in FIG. 4 since the cylinder wall opening and the piston wall opening of the inlet valves 142-148 are not located opposite each other but are closed by the opposite piston wall and cylinder wall, respectively. By pro-viding a plurality of inlet valves 142-148 the so-called sealing length is in-creased, i. e. the length of the piston-cylinder gap between the piston wall opening and the cylinder wall opening of the same inlet valve. When four inlet valves 142-148 are provided, the sealing length is quadrupled such that the gas leakage flow is considerably reduced. This is advantageous, in particular, in the case of a piston compressor with only a short piston stroke which, in turn, results in a short sealing length between the two wall openings of an inlet valve. Another section of the compressed-gas supply line 160 extends in the piston 112 between a third and fourth inlet valve 144,146.

In the cylinder 114 an anti-twist device is provided which prevents the piston 112 from twisting in the cylinder 114. The anti-twist device may e. g. be a non-circular configuration of the magnetic parts of the motor fixed at the piston 112, the parts being located opposite corresponding magnetic pole shoes.

In the third embodiment of a piston compressor 210 shown in FIGS. 5 and 6 both the piston 212 and the cylinder 214 comprise gas bearing nozzles 228, 229. For supplying the cylinder-side gas bearing nozzles 229, a second inlet valve 250 is provided which is connected with the first inlet valve 242 by the piston-side compressed-gas accumulator 234. Via the second inlet valve 250 a cylinder-side compressed-gas accumulator 252 is supplied with compressed gas when the piston 212 is in its filling position shown in FIG. 5.

The piston 212 is actuated by a motor 260 which essentially comprises an electromagnet 262 cooperating with a permanently magnetized portion of the piston. The piston 212 can have a reduced outer circumference in the area of the electromagnet 262, whereby the cylinder 214 can include the axial length of the motor 260. This allows the manufacturing costs to be reduced and the bearing quality to be increased.

Figure 7:
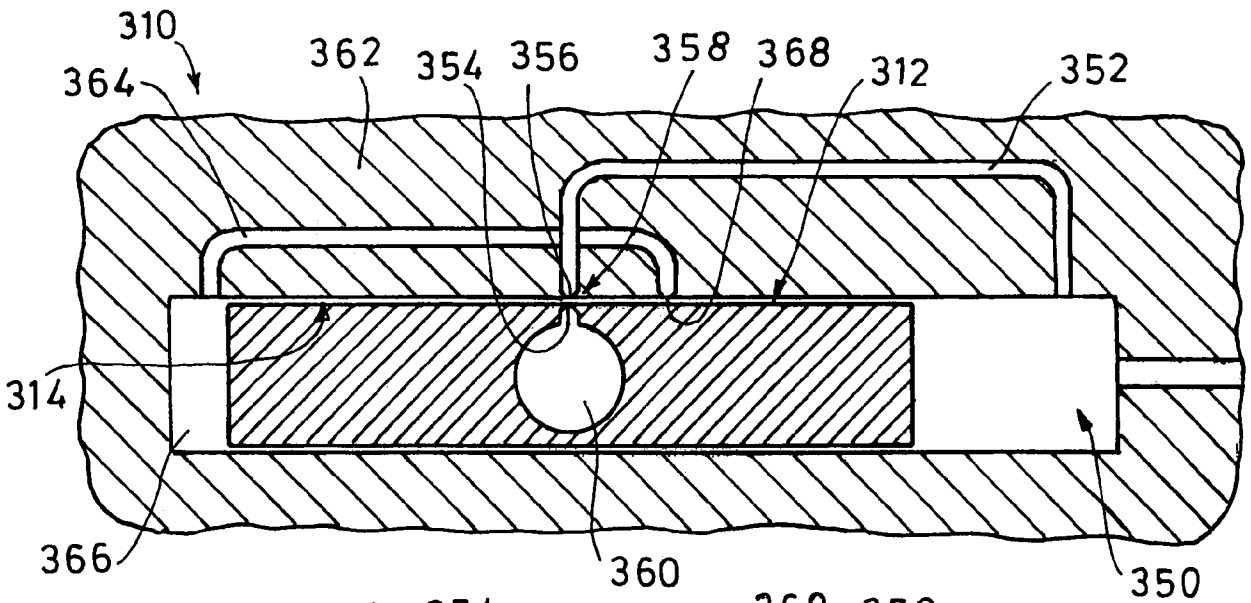
FIG. 7 shows a fourth embodiment of a piston compressor comprising a piston end-position control device, with the piston in its filling position.
Figure 8:
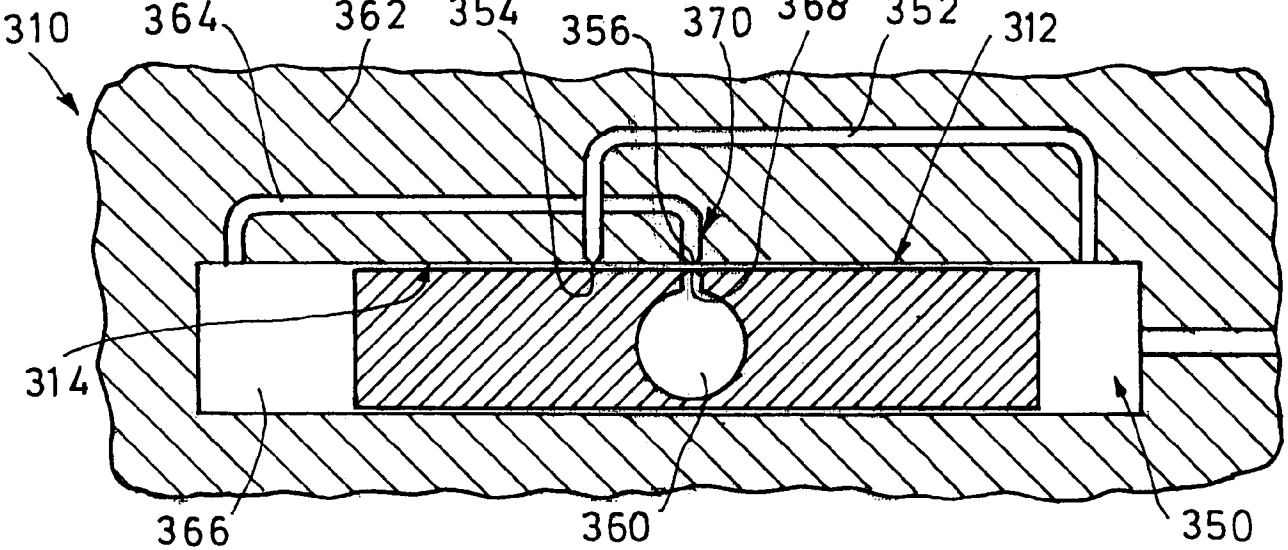
FIG. 8 shows the piston compressor of FIG. 7, with the piston in a non-filling position.
Figure 9:
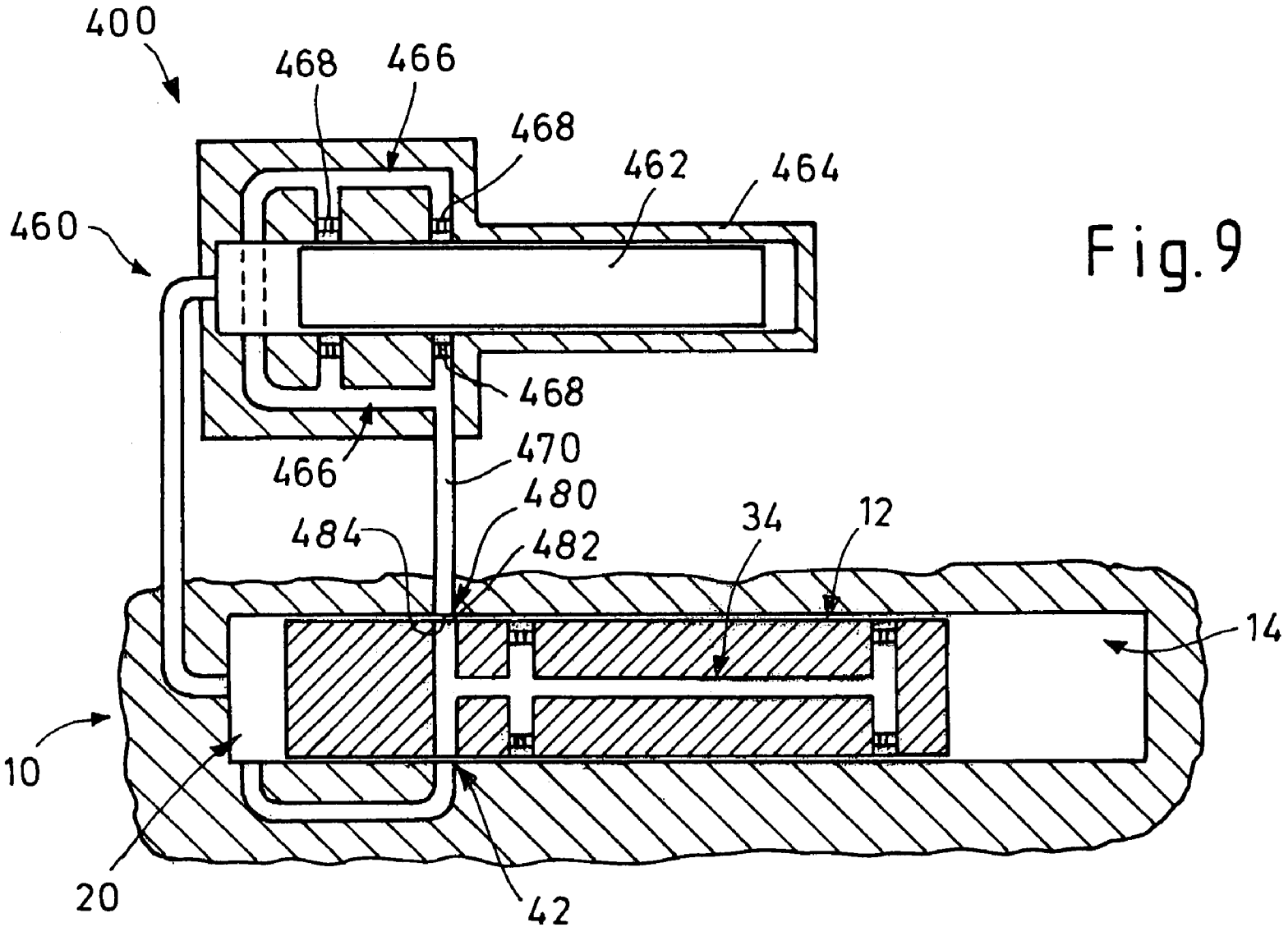
FIG. 9 shows a fifth embodiment of a piston compressor forming part of a Stirling cooler which comprises a cold finger, with the piston compressor piston in its filling position.

FIGS. 7 and 8 show a fourth embodiment of a piston compressor, wherein the piston bearing in the cylinder is omitted. The piston compressor 310 comprises a piston 312 on gas bearing, which oscillates in a cylinder 314 and is supported on compressed gas, as described in the embodiments shown in FIGS. 1-6. The piston end-position control device described hereunder can also be actuated by means of different piston-cylinder arrangements.

The piston end-position control device shown in FIGS. 7 and 8 serves for con-trolling the end position of the piston 312 in its filling position shown in FIG. 7. The filling position is strictly maintained since this is the only way to ensure that the piston wall opening and the cylinder wall opening of an inlet valve are exactly aligned with each other, and that the inlet valve de-fined by the two openings has a sufficiently large opening cross-section and a sufficiently long opening duration to allow complete recharge of the piston compressor compressed-gas accumulator.

The piston compressor 310 comprises a constant-pressure gas source 350 where the gas pressure is always constant. The constant-pressure gas source 350 is connected via a line 352 with a cylinder wall opening 354 which, in the end or filling position of the piston 312 shown in FIG. 7, is aligned with a piston wall opening 356 and defines together with the latter an open charge valve 358.

In the piston 312 a control pressure accumulator 360 is provided to which, in the filling position of the piston 312, the gas pressure of the compressed-gas source 350 is applied.

Further, a line 364 is provided in the cylinder housing 362, the line 364 connecting the cylinder pressure space 366 with a second cylinder wall opening 368. The second cylinder wall opening 368 defines together with the piston wall opening 356 a discharge valve 370 which is open in the non-end position of the piston 312 shown in FIG. 8 such that the gas pressures of the control pressure accumulator 360 and the cylinder space 366 adjust to each other.

In the end or filling position of the piston 312 shown in FIG. 7 the piston 312 is in its end position near the cylinder space 366. At this time, the gas pressure in the cylinder space 366 is higher than that in the control pressure accumulator 360 or the constant-pressure gas source 350. In this position of the piston 312 the control valve 358 is open such that the gas pressure in the control pressure accumulator 360 adjusts itself to the gas pressure of the constant-pressure gas source 350. This gas pressure is higher than the gas pressure in the cylinder pressure space 366 when the piston 312 is in its non-end position shown in FIG. 8. In the non-end position of the piston 312 shown in FIG. 8 the control valve 358 is closed and the discharge valve 370 is open. Thereby, the pressure in the cylinder pressure space 366 is adjusted to the pressure in the control pressure accumulator 360 such that, in this piston position, the cylinder pressure space 366 contains always approximately the same amount of gas.

At an excessive pressure, i. e. when an excessive amount of gas is in the cylinder pressure space 366, the end position of the piston 312 shown in FIG. 7 is not reached such that no gas from the constant-pressure gas source 350 is supplied to the control pressure accumulator 360. Due to the unavoidable gas loss and thus the pressure drop in the cylinder pressure space 366, the cylinder space-side end position of the piston 312 moves cycle-wise towards the cylinder pressure space 366 until, in its end position, the control valve 358 is opened again. In this manner, the pressure-side end position of the piston 312 is controlled and/or limited.

For controlling the right end position of the piston 312, a second corresponding piston end-position control device may be provided.

The described control of the piston end position leads to a defined location of the maximum compressor pressure, wherein the valve action of the inlet valves shown in FIGS. 1-6 is not much worse than that of conventional flatter valves, but the inlet valves operate in an absolutely wear-free manner.

Actuation of the piston by a moving magnet or iron core offers the advantage that no moving electrical lines are required. Further, a resilience is produced by the magnetic field such that a centering spring is not required. Thus all wear parts and springs, which are susceptible to breakage, are omitted.

If the electromagnet 260 and/or the ferromagnetic parts connected with the piston 212 have no rotationally symmetrical configuration, guiding along the axis of rotation is effected such that a mechanical anti-twist device can be omitted.

FIG. 9 shows a Stirling cryocooler 400 formed by a piston compressor 10 and a cold finger 460. The cold finger 460, in turn, is formed by a displacer piston 462 which oscillates in a cold finger cylinder housing 464. The displacer piston 462 is gas-supported in the cold finger housing. For this purpose, the cold finger 460 comprises a cold finger compressed-gas accumulator 466. Further, gas bearing nozzles 468 for supporting the displacer piston 462 are provided in the cylinder housing 464. The gas bearing nozzles 468 are supplied with compressed gas from the compressed-gas accumulator 466. The piston compressor compressed-gas accumulator 34 is connected via a cold finger gas supply line 470 with the cold finger compressed-gas accumulator 466. Between the piston compressor compressed-gas accumulator 34 and the cold finger gas supply line 470 a cold finger valve 480 is provided which is defined by a piston wall opening 482 and a cylinder wall opening 484 of the piston compressor 10 and which is open when the piston compressor piston 12 is in its filling position shown in FIG. 9. In the filling position of the piston compressor piston 12 the compressed-gas accumulator 466 of the cold finger 460 is also supplied with compressed gas. The cold finger valve 480 is configured in the same way as the piston compressor inlet valve 42.

When the piston compressor piston 12 is in its filling position, the compressed gas flows into the cold finger compressed-gas accumulator 466 and is discharged during the entire moving cycle of the displacer piston 462 via the cold finger gas bearing nozzles 468.

The Stirling cooler shown is a split Stirling cooler, wherein an overflow line 490 supplies the cold finger 460 with gas from the piston compressor 10.

The displacer piston 462 is supported by the gas bearing nozzles 468, which are arranged in two transversal planes, exclusively in the "warm" half of the cold finger cylinder housing 464. This arrangement of the cold finger gas bearing nozzles 468 prevents the relatively warm gas flowing out of the cold finger gas bearing nozzles 468 from warming up the cold side of the cold finger 460.

During movement of the piston compressor piston 12 into the non-filling position, the pressure in the piston compressor cylinder pressure space 20 quickly decreases, whereas the gas pressure in the two compressed-gas accumulators 34,466 is reduced slowly via the gas bearing nozzles 28,468 of the piston compressor 10 and the cold finger 460 and via the so-called piston leakages. As long as the piston compressor piston 12 oscillates at a sufficiently high frequency, an adequate pressure difference exists at any time upstream and downstream of the gas bearing nozzles 28,468, which maintains the gas support of the pistons 12,462. The small gas flow from the gas bearing nozzles 468 of the cold finger 460 is returned via the overflow line 490 into the cylinder pressure space 20 of the piston compressor 10.

The invention has been described with reference to the preferred embodiments. Modifications and alterations may occur to others upon reading and understanding the preceding detailed description. It is intended that the invention be constructed as including all such modifications and alterations insofar as they come within the scope of the appended claims or the equivalents thereof.

Having thus described the preferred embodiments, the invention is now claimed to be:

1. A piston compressor comprising:

a cylinder housing which forms a cylinder wall that defines a cylinder;

a piston which oscillates in the cylinder and, in a filling position, compresses gas in a cylinder pressure space, the piston defining a piston wall which faces the cylinder wall;

gas bearing nozzles arranged adjacent the piston for gas-supporting the piston, at least one of the gas bearing nozzles being arranged in the cylinder housing and facing the piston wall;

a compressed-gas accumulator connected with the gas bearing nozzles;

a compressed-gas supply line between the cylinder pressure space and the compressed-gas accumulator; and an inlet valve in the compressed-gas supply line, the inlet valve being open in the filling position of the piston the inlet valve being defined by a cylinder wall opening and a piston wall opening which, in the filling position of the piston, are located opposite each other and define an open valve, and, in a non-filling position, are closed by the piston wall and the cylinder wall, respectively, and define a closed valve.

2. The piston compressor according to claim 1, wherein at least one of the cylinder wall opening and the piston wall opening are configured as a circular groove.

3. The piston compressor according to claim 1, wherein the compressed-gas supply line is arranged in the cylinder housing between the cylinder pressure space and the inlet valve.

4. The piston compressor according to claim 1, wherein the compressed-gas supply line is arranged in the piston between a piston end and the piston wall.

5. A piston compressor comprising:

a cylinder housing which forms a cylinder wall that defines a cylinder;

a piston which oscillates in the cylinder and, in a filling position, compresses gas in a cylinder pressure space, the piston defining a piston wall which faces the cylinder wall;

gas bearing nozzles arranged adjacent the piston for gas-supporting the piston, each gas bearing nozzle being formed by a wire inserted in a nozzle bore.

6. The piston compressor according to claim 4, wherein in the compressed-gas supply line a second inlet valve defined by a second cylinder wall opening and a second piston wall opening is arranged.

7. The piston compressor according to claim 1, wherein in the cylinder, an anti-twist device is provided which prevents the piston from twisting in the cylinder.

8. The piston compressor according to claim 5, wherein the compressed-gas accumulator and the gas bearing nozzles are arranged in the piston.

9. The piston compressor according to claim 1, wherein each gas bearing nozzle is formed by a gas-permeable plug of sintered material.

10. The piston compressor according to claim 1, wherein at least one of the gas bearing nozzles is arranged in a respective transversal plane adjacent end portions of the piston.

11. The piston compressor according to claim 1, wherein at least one of the gas bearing nozzles is provided in the piston.

12. The piston compressor according to claim 8, wherein the gas bearing nozzles are arranged in the cylinder housing.

13. A piston compressor comprising:

a cylinder housing which forms a cylinder wall that defines a cylinder;

a piston which oscillates in the cylinder and, in a filling position, compresses gas in a cylinder pressure space, the piston defining a piston wall which faces the cylinder wall;

gas bearing nozzles arranged adjacent the piston for gas-supporting the piston;

a compressed-gas accumulator connected with the gas bearing nozzles;

a compressed-gas supply line between the cylinder pressure space and the compressed-gas accumulator;

an inlet valve in the compressed-gas supply line, the inlet valve being open in the filling position of the piston the inlet valve being defined by a cylinder wall opening and a piston wall opening which, in the filling position of the piston, are located opposite each other and define an open valve, and, in a non-filling position, are closed by the piston wall and the cylinder wall, respectively, and define a closed valve; and a pneumatic piston end-position control device which comprises:

a control pressure accumulator in the piston, wherein the control pressure accumulator is connected with a control pressure accumulator piston wall opening in the piston wall, a constant-pressure gas source connected via a line with a cylinder wall opening which defines together with the control pressure accumulator piston wall opening a control valve and, in the filling position of the piston, is located opposite the control pressure accumulator piston wall opening, and a line between the cylinder pressure space and a cylinder wall opening which together with the control pressure accumulator piston wall opening defines a discharge valve and, during a cycle in a non-filling position of the piston, is located opposite the control pressure accumulator opening.

14. A stirling cooler comprising:

a cold finger, and a piston compressor according to claim 1, wherein:

the cold finger comprises a displacer piston in a cold finger cylinder housing, the cold finger comprises a compressed-gas accumulator and gas bearing nozzles connected therewith for supporting the displacer piston, the cold finger compressed-gas accumulator is connected via a cold finger gas supply line with the piston compressor compressed-gas accumulator, and in the cold finger gas supply line, a valve is arranged which is defined by a piston wall opening and a wall opening of the piston compressor and is opened when the piston compressor piston is in the filling position.

15. The piston compressor according to claim 1, further including:

an associated supply line connected with the compressed gas accumulator and adapted for connection with an associated device.

16. A piston compressor including:

a cylinder housing which forms a cylinder wall that defines a cylinder;

a piston which oscillates in the cylinder and, in a filling position, compresses gas in a cylinder pressure space, the piston defining a piston wall which faces the cylinder wall;

gas bearing nozzles arranged adjacent the piston for gas-supporting the piston;

a compressed-gas accumulator connected with the gas bearing nozzles;

a compressed-gas supply line between the cylinder pressure space and the compressed-gas accumulator;

an inlet valve in the compressed-gas supply line, the inlet valve being open in the filling position of the piston the inlet valve being defined by a cylinder wall opening and a piston wall opening which, in the filling position of the piston, are located opposite each other and define an open valve state, and, in a non-filling position, are closed by the piston wall and the cylinder wall, respectively, and define a closed valve state an associated device supply line connected with the compressed gas accumulator;

an associated device accumulator connected with the associated device supply line, and an associated device air bearing connected with the associated device accumulator.

17. The piston compressor according to claim 16, further including:

an associated device piston supported by the associated device air bearings.

18. The piston compressor according to claim 17 wherein the associated device is a cold finger.

* * * * *